US005310131A

United States Patent [19]

Monaco et al.

[11] Patent Number: 5,310,131

[45] Date of Patent: May 10, 1994

[54] THIN MATERIAL HANDLING SYSTEM FOR USE IN DOWNCOILERS AND METHOD

[75] Inventors: Gaetano Monaco, Hamilton; Lorn D. Newton, Lynden; Francis I. Bailey, Hamilton, all of Canada

[73] Assignee: Stelco Inc., Ontario, Canada

[21] Appl. No.: 854,625

[22] PCT Filed: Dec. 20, 1990

[86] PCT No.: PCT/CA90/00452

§ 371 Date: Jun. 29, 1992

§ 102(e) Date: Jun. 29, 1992

[87] PCT Pub. No.: WO91/09694

PCT Pub. Date: Jul. 11, 1991

[30] Foreign Application Priority Data

Dec. 29, 1989 [GB] United Kingdom ..... 8929342.7
May 2, 1990 [GB] United Kingdom ..... 9009863.3

[51] Int. Cl.[5] ..... B21C 47/24; B21C 47/16

[52] U.S. Cl. ..... 242/79; 72/200; 242/78.6; 414/911

[58] Field of Search ..... 242/79, 78.6, 78.1; 414/911, 222; 22/200, 202, 428; 198/954, 774.2, 774.4, 777

[56] References Cited

U.S. PATENT DOCUMENTS

| | | | |
|---|---|---|---|
| 2,687,878 | 8/1954 | Montgomery | 242/78.6 |
| 4,005,830 | 2/1977 | Smith | 242/78.1 |
| 4,019,359 | 4/1977 | Smith | 242/78.1 X |
| 4,306,438 | 12/1981 | Child et al. | 242/78.1 X |

FOREIGN PATENT DOCUMENTS

| | | | |
|---|---|---|---|
| 286082 | 12/1988 | European Pat. Off. . | |
| 0468716 | 1/1992 | European Pat. Off. | 72/202 |
| 594887 | 3/1934 | Fed. Rep. of Germany . | |
| 3743057 | 1/1988 | Fed. Rep. of Germany . | |
| 3714432 | 10/1988 | Fed. Rep. of Germany . | |
| 0060805 | 3/1991 | Japan | 72/202 |
| 400761 | 11/1933 | United Kingdom . | |
| 607350 | 8/1948 | United Kingdom . | |

OTHER PUBLICATIONS

Patent Astracts of Japan, vol. 4, No. 187 (M-48) (669) 23 Dec. 1980, & JP-A-55 133803 (Hitachi) 18 Dec. 1980, see the whole document.

*Primary Examiner*—Joseph J. Hail, III
*Assistant Examiner*—John Rollins
*Attorney, Agent, or Firm*—Shoemaker and Mattare Ltd.

[57] ABSTRACT

A method and apparatus for manipulating hot metallic material includes placing a coil of the material at a first position, the coil having an open coil eye, and initiating uncoiling of the coil while it is in the first position. During uncoiling, the coil is transferred to a second position by moving it in a direction transverse to its axis, and heat loss from the coil side edges and eye is restricted by providing a heat shield closely adjacent to the side edges. The uncoiling continues at the second position, and when the coil is near the end of the uncoiling operation at the second position, a coil opener pin is inserted axially into the open coil eye without contacting the coil, thus avoiding conductive heat loss to the pin. Finally, at the completion of the uncoiling operation, the last few coil wraps are pulled into contact with the pin as the coil is pulled downstream out of the second position, whereby the pin prevents collapsing or crushing of the final portion of the coil. An optional holdback roll located downstream of the second position is such as to come in contact with the final wraps of the coil as the latter is pulled downstream out of the second position, and the pin is positioned so as to enter the open eye of the coil whether or not the coil has moved from the second position.

13 Claims, 7 Drawing Sheets

THIN MATERIAL HANDLING SYSTEM FOR USE IN DOWNCOILERS AND METHOD

The present invention is directed to a method and an apparatus useful in the transfer of high-temperature slabs or strip from one or more slab-producing assemblies such as continuous casting machines, to an in-line or off-line hot reduction mill.

BACKGROUND OF THIS INVENTION

Three prior patents of major importance in this field are the following:

U.S. Pat. No. 4,019,359, issued Apr. 26, 1977 to the Steel Company of Canada, Limited;

U.S. Pat. No. 4,005,830, issued Feb. 1, 1977 to the Steel Company of Canada, Limited;

U.S. Pat. No. 4,306,438, issued Dec. 22, 1981 to the Steel Company of Canada, Limited.

Prior to the innovations represented by the above-three patents, the conventional method of rolling hot metal strip involved the heating of an ingot or slab to approximately 2300° F. (for steel) and reducing it in thickness by rolling it through a series of rolling mill stands. Normally, the rolling sequence took place in two stages referred to as roughing and finishing.

In the roughing stage, the slab or ingot was normally rolled through one or more rolling mill stands in a series of passes until it was reduced in thickness to a transfer bar approximately one inch thick. The roughing mill stage would typically include one or more vertical edging mills.

Following the roughing operation, the transfer bar was transferred on table rolls to a continuous finishing mill train where it was further reduced to the desired gauge.

Certain problems were encountered in the above-described conventional method of rolling hot metal strip, particularly arising from the long length of time that it took the transfer bar to feed into the finishing mill train. In order to address these problems, the inventions represented by the three U.S. patents listed above were developed.

Essentially, these three patents relate to the construction and operation of a downcoiler (and improvements thereon), capable of wrapping a strip or transfer bar about itself into a coreless coil (i.e. a coil with an open central eye), in which the heat contained in the strip was largely retained and not allowed to dissipate away. The heat retention arose from the compact form assumed by the strip or transfer bar when coiled upon itself.

The improvement represented by U.S. Pat. No. 4,005,830 related to the combination of a downcoiler with means allowing the simultaneous uncoiling of a previously coiled strip and the coiling-up of a new strip. In order to accomplish this, U.S. Pat. No. 4,005,830 describes and claims the use of pivotally mounted transfer arms, one on either side of the coil, equipped with inwardly directed stub mandrels capable of entering the open eye of a coil and then swiveling through approximately 100° in order to move the coil from a coiling location (directly downstream of the bend rollers) to an uncoiling location further downstream. one major advantage of this construction is that it allowed a coiled-up strip to begin uncoiling at the coiling location, and then be transferred to the uncoiling location while uncoiling is taking place, so that the uncoiling can be completed in the second location. Meanwhile, a new strip or transfer bar could begin coiling up at the coiling location.

While the method and apparatus set forth in U.S. Pat. No. 4,005,830 represented a marked improvement over previous approaches (and have met with considerable commercial success) there is still room for further improvement in order to address the following disadvantages of the prior system using transfer arms.

a) Because of the high temperature of the strip or slab when it is in the coiled condition, considerable heat loss takes place from the hot edges, radiating laterally away from the coil. Heat is also radiated from the hollow eye of the coil. Although the use of heat shielding was known at the time the invention set out in U.S. Pat. No. 4,005,830 was made, the arrangement of the various elements in that prior patent were such as to prevent the use of close-lying heat shields to substantially limit heat loss from the hot edges and the coil eye. More specifically, the presence of the transfer arms and the necessity that the transfer arms be capable of lateral movement parallel with the coil axis, prevented the positioning of heat shields where they would do the most good, namely directly adjacent the hot side edges of the coil.

b) Further, the necessity of physical contact between the stub mandrels and the inside convolution of the coil (in order to transfer the coil from the coiling to the uncoiling position) caused heat to be taken away from the coil. Because the coil was rotating during the transfer procedure, "cold spots" were largely eliminated, but an unavoidable heat loss did occur simply due to the contact.

c) A further difficulty with the prior development related to the crushing or crumpling of the tail end of the slab or strip just as the uncoiling is being completed. More specifically, the inner "wrap" of the coil is fairly tightly curved, and by the time the uncoiling procedure is completed the temperature of the inside wrap has dropped, thereby making it stiffer and more resistant to flattening out. In U.S. Pat. No. 4,005,830, the straightening or flattening of the final portion of the coiled strip or slab was achieved by leaving the stub mandrels in the open eye of the coil at the uncoiling position. However, it will be understood that, if the transfer arms and stub mandrels were removed in order to allow closely adjacent heat shielding, the problem of crushing or crumpling the stiff, curved tail end of the strip or slab would resurface.

There is no doubt that a significant advantage would accrue if one were able to dispense with the transfer arms while providing some modality by which the job of the transfer arms could be accomplished, one which did not interfere with the positioning of laterally adjacent heat shielding. If that could be accomplished, one would then have to address the problem of insuring that the tail end of an uncoiling transfer bar or strip could be flattened out in order to avoid crushing or crumpling of the final portion.

The above considerations are all addressed in the present invention.

Additional prior publications of interest are as follows: DE OS 2613459, laid open Oct. 13, 1977; DE 3743057, granted on Sep. 1, 1988; European Patent Application 0327855, published 16.08.89; European Patent Application 0327854, laid open 16.08.89; European Patent Application 0320846, published 21.06.89; European Patent Application 0309656, published 05,04.89; U.S. Pat. No. 4,829,656, issued May 16, 1989;

U.S. Pat. No. 4,703,640, issued Nov. 3, 1987; U.S. Pat. No. 4,611,988, issued Sep. 16, 1986; U.S. Pat. No. 4,528,434, issued Jul. 9, 1985; U.S. Pat. No. 4,698,897, issued Oct. 13, 1987;

GENERAL DESCRIPTION OF THIS INVENTION

The present invention addresses and overcomes the problems described in the previous section.

Specifically, the present invention provides an improved method and apparatus for manipulating and handling high-temperature slabs or strip in a transfer procedure which moves the slabs or strip ultimately to an in-line or off-line hot reduction mill. The initial manufacture of the slabs or strip may utilize the older technique of rolling ingots, or the somewhat more recent technique involving continuous casting. However, the present invention is independent of the actual origin or ultimate destination of the high-temperature slabs or strips.

More particularly, this invention provides a method of manipulating a coil (18, 217, 218) of hot metallic material having an open coil eye, utilizing apparatus which includes first coil support means (56) defining a first coil position (**18*f*), second coil support means (56, 200) defining a second coil position (18*h*), coil transfer means (56) for moving a coil from said first position (18*f*) to said second position (18*h***) while the coil axis remains transverse to the direction of coil movement, the method comprising the steps:

a) placing a coil in said first position (**18*f*), then, in any order, b) initiating the uncoiling operation, c) using said coil transfer means (56) to transfer said coil to said second position (18*h*), and then, d) completing the uncoiling operation, characterized in that, step c) is carried out without contacting said open coil eye and without inserting anything into said eye, and is accompanied by restricting heat loss from the side edges and the coil eye through the provision of heat shield means (83) located closely adjacent the side edges of the coil (18) throughout its movement from its first position (18*f*) to its second position (18*h*), step d) is carried out by providing a coil opener pin (202, 202*a*, 202*b*, 202*c*) adjacent to said second position (18*h*) and parallel to the coil axis, the pin being capable of axial movement, step d) being further carried out by inserting the pin (202, 202*a*, 202*b*, 202*c*) into the coil eye, without contacting the coil (18), when the coil (18) is near the end of the uncoiling operation at said second position (18*h*), step d) being further carried out by allowing the last few coil wraps to contact the pin (202, 202*a*, 202*b*, 202*c*) as the coil (18) is pulled out of the second position (18*h*), such that the pin (202, 202*a*, 202*b*, 202*c*) prevents collapsing or crushing of the final portion of the coil (18**).

Further, this invention provides an apparatus for manipulating a coil (18, 217, 218) of hot metallic material having an open coil eye, comprising:

first coil support means (56) defining a first coil position (**18*f*), second coil support means (56, 200) defining a second coil position (18*h*), coil transfer means (56) for moving a coil from said first position (18*f*) to said second position (18*h*) while the coil axis remains transverse to the direction of coil movement, characterized in that, the apparatus further comprises heat shield means (83) located closely adjacent the coil (18) throughout its movement from the first position (18*f*) to the second position (18*h*), for restricting heat loss from the side edges and the coil eye while the coil (18) moves), the apparatus further comprising a coil opener pin (202, 202*a*, 202*b*, 202*c*) adjacent to said second position (18*h*) and parallel to the coil axis, the pin being capable of axial movement whereby it can be inserted into the coil eye, without contacting the coil (18), when the coil (18) is near the end of the uncoiling operation at said second position (18*h*), such that the last few coil wraps contact the pin (202, 202*a*, 202*b*, 202*c*) as the coil (18) is pulled out of the second position (18*h*), and the pin (202, 202*a*, 202*b*, 202*c*) prevents collapsing or crushing of the final portion of the coil (18**).

GENERAL DESCRIPTION OF THE DRAWINGS

Several embodiments of this invention are illustrated in the accompanying drawings, in which like numerals denote like parts throughout the several views, and in which.

DETAILED DESCRIPTION OF THE DRAWINGS

Before proceeding, it should be made clear that the method and apparatus set forth here are applicable not only to thin slabs (as described) but to any thin material that can be handled by the various components. Strip material is one example. Furthermore, it is contemplated that this development could also be used for other metals like aluminum and stainless steel, and for other materials like plastics or composites.

Figure 1:
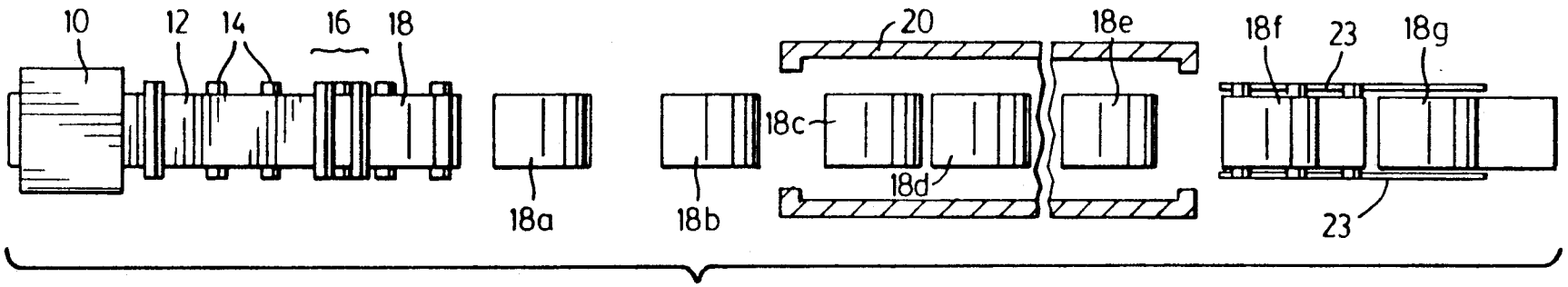
FIG. 1 is a conceptual, schematic plan view of a processing line for previously formed strip or slab, with which the present invention can be used.
Figure 2:
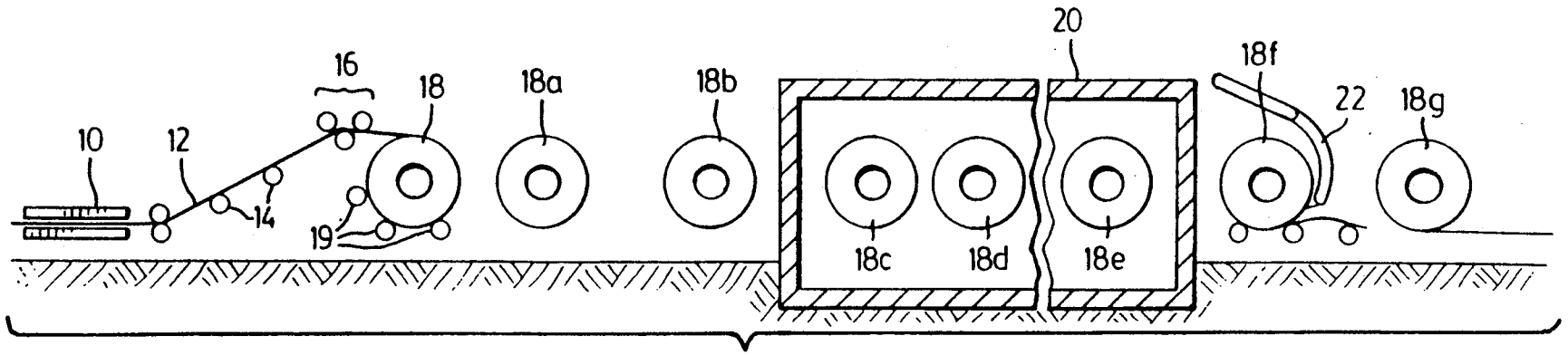
FIG. 2 is a schematic elevational view of the arrangement shown in FIG. 1.

Attention is now directed to FIGS. 1 and 2, which provide an overall schematic view of apparatus constructed in accordance with this invention.

In FIG. 1, the item 10 may be either a heater or a passive heat shield, which receives thin cast slab from a continuous caster (not shown) or equivalent means. The slab is shown at 12, and moves from left to right in FIGS. 1 and 2. The slab 12 is directed to move upwardly at an incline by various rollers 14, passes through bend rollers 16, and is then downcoiled to form a coil 18 resting on support rollers 19. The innermost coil wrap is substantially circular.

Figures 4, 5:
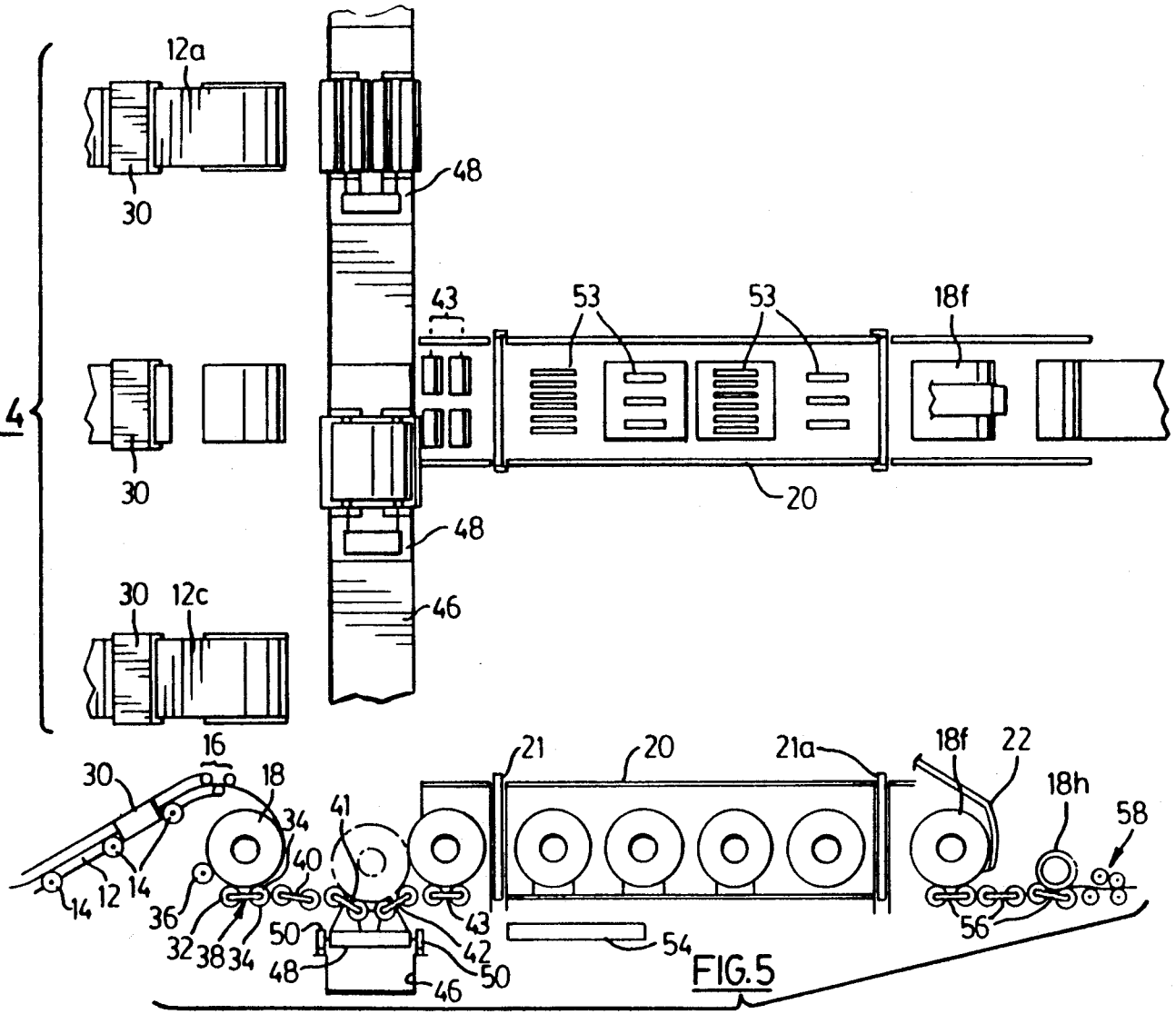
FIGS. 4 and 5 are a plan view and an elevational view, respectively, of a particular embodiment showing one method of transferring coils in directions both parallel and perpendicular to their axes.

The coils illustrated at 18*a* and 18*b* show stages in the rightward movement of the coil 18, prior to entry into the left (upstream) end of a temperature equalization furnace 20 upon raising of an upstream furnace door (shown at 21 in FIG. 5).

Within the furnace 20 the illustration of additional coils 18*c*, 18*d* and 18*e* represents rightward movement of the coils within the furnace, and can also be taken to represent the idea that the furnace 20 is capable of holding a plurality of coils simultaneously, as these move from left to right in the figure. A downstream furnace door 21*a* is provided at the rightward end of the furnace 20 (see FIG. 5).

To the right of the furnace 20, a further coil 18*f* shows the coil position from which the material is uncoiled. The numeral 22 designates a peeler arm of conventional nature, which peels away the leading end in order to begin the rolling in the hot reduction mill which exists to the right of FIGS. 1 and 2 and is not illustrated. The coil marked 18*g* shows a position downstream of the coil 18*f*, to which a coil can be moved during uncoiling, in order to make room for the next coil at the position 18*f*. While the arrangement shown in FIGS. 1 and 2 is such that the mandrelless downcoiling procedure takes place at a location remote from the position identified as 18*f* (immediately downstream of the furnace 20), it will be appreciated from the description below that it is possible for the strip or slab to be coiled at the position represented by 18*f* in FIG. 2, thus bypassing and completely eliminating the necessity for furnace 20.

In FIG. 1, heat shields 23 are illustrated closely adjacent the coils shown at 18*f* and 18*g*.

Figure 3:
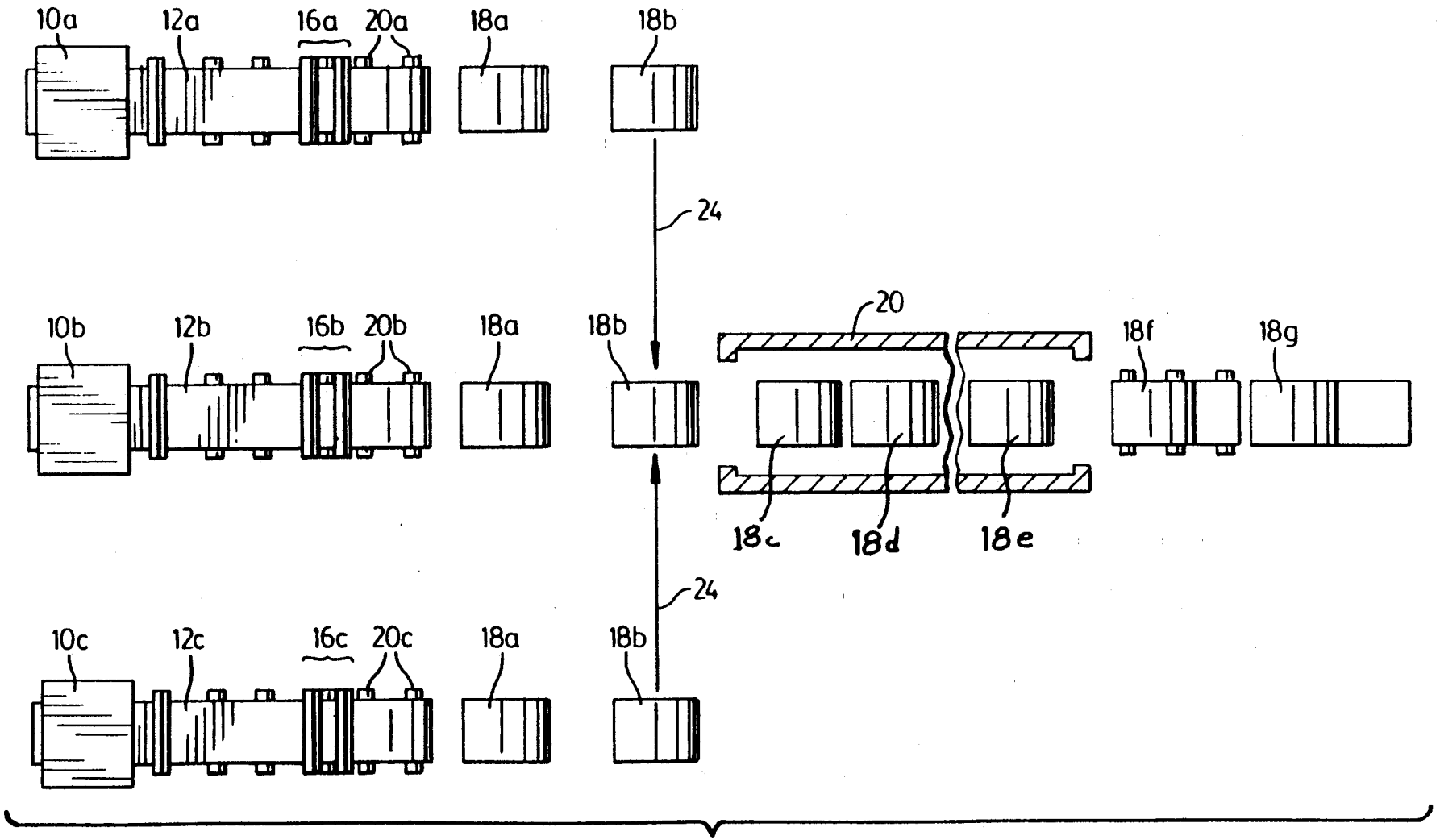
FIG. 3 is a schematic plan view similar to FIG. 1, but showing the employment of a plurality of continuous casters.

Attention is now directed to FIG. 3 which is similar to FIG. 1, except that it shows three thin slabs 12*a*, 12*b* and 12*c*, each proceeding from a different thin slab continuous caster, and each being coiled in a separate apparatus including bend rollers 16*a*, 16*b* and 16*c*, and separate support rollers 20*a*, 20*b* and 20*c*.

Three coils 18*a* are illustrated in the process of being transferred rightwardly from the respective downcoiler apparatuses, and the three coils 18*b*, along with arrows 24, represent a provision (not illustrated in FIG. 3) of means by which coils 18*b* can be transported in the direction parallel with their axes, so as to bring them one at a time adjacent the upstream end of the furnace 20.

Attention is now directed to FIGS. 4 and 5, which illustrate a particular modality for ensuring the movement of coils from the downcoiler apparatuses to the upstream end of the furnace 20, thence through the furnace, thence to the uncoiling station.

Turning first to FIG. 5, it will be seen that the thin slab 12 passes upwardly and obliquely to the right along a guideway which includes rollers 14, and which further includes induction heaters 30 which surround all or part of the thin slab 12, and serve to maintain its heat content. It will be understood that the thin slab or strip material could also pass directly from a caster in a horizontal path straight into the bending rolls 16 of a coil box.

The essential purpose of the induction heaters 30 is to raise the temperature of the edges of the strip or slab. In a preferred embodiment, the complete path of a cast steel thin slab or strip would be contained within a heat-shielded box. As an alternative, the strip or slab could be heated with gas, which is likely to be a cheaper method. In this arrangement, the complete strip or slab would be contained in a furnace, but the heat input would be concentrated on the edges of the workpiece. It will thus be understood that the heaters 30 are not restricted to being "induction" heaters.

It will be noted that the coil 18 in FIG. 5 rests on two support rollers 32 and 34, and further rests against a guide roller 36. It will further be noted that the rollers 32 and 34 are illustrated as joined by a swing frame 38. The swing frame 38 extends, as can be seen, between the axes of the rollers 32 and 34. In a preferred embodiment the swing frame 38, which literally supports the rollers 32 and 34 for revolution, is itself mounted for rotation about an axis which lies parallel to the axes of the rollers 32 and 34, but mid-way between them. Thus, the swing frame 38 can rotate away from the position shown in FIG. 5, such that one of the rollers 32, 34 moves upwardly, and the other moves downwardly.

As can be further seen in FIG. 5, additional swing frames 40–43 are arranged rightwardly of the swing frame 38, and each carries a pair of rollers which function in exactly the same way as described for the swing frame 38. It will thus be understood that by carefully controlling the amount and sequence of "tilt" of the swing frames 38, 40–43, it will be possible to shift a coil in any desired direction. The various support rollers (including rollers at either end of the furnace 20) may be driven in either one or both directions. This is considered to be especially advantageous at the uncoiling (downstream) end of the furnace 20 for the swing frames marked 56, where the coil is being paid off into the mill.

Looking now simultaneously at FIGS. 4 and 5, it will be seen that a flume 46 is provided parallel to the axes of the coils as formed, and moreover that a carriage 48 has wheels 50 allowing the carriage 48 to move lengthwise of the flume 46. In FIG. 4, the carriage 48 is illustrated in solid lines at two possible positions along the flume 46. In actual fact, if three casters are to be used with a single finishing mill, then two carriages would be installed, in order to ensure reliable coil transfer.

It will be further noted in FIG. 5 that the swing frames 41 and 42 are mounted on the carriage 48. It will be understood that there will be three each of the swing frames 38 and 40 (one for each caster), but only a single swing frame 43, located adjacent the upstream end of the furnace 20.

While the various swing frames are mounted for rotation about the mounting axis, it will be understood that each swing frame would have a guide mechanism which controls the precise orientation of the swing frame in order to accomplish the movement of the coils.

In FIG. 4 the portions marked 53 represent the static supports for the coils in the furnace 20. These static supports 53 allow coils to be "walked" rightwardly along the furnace 20 by using the conventional walking beam arrangement. The rectangular configuration identified by the numeral 54 in FIG. 5 represents the action of the walking beams. Typically, one long walking beam structure underneath the furnace 20 would first raise and lift all the coils up away from their supports 53 (these being stationary). The walking beam together with all the raised coils then traverses one pitch to the right (the top long side of the rectangle 54), then lowers the coils into the next support (for each coil) and then returns one pitch to the left into a holding position. The various different patterns of coil supports in the furnace 20, shown by the numeral 53 in FIG. 4, are provided so that each coil will be supported in a different position each time it moves, thus preventing hot spots or cold spots forming in certain areas of the coil.

Returning to FIG. 5, it will be noted that a further set of swing frames 56, each with a pair of rollers, is provided from left to right adjacent the downstream end of the furnace 20, the purpose being to transfer the coil 18*f* from the leftward position to the position identified as 18*h*, thus to leave vacant the position immediately adjacent the downstream end of the furnace 20, so that next coil in line can be moved to that position. In FIG. 5 at the right, a special hold-back roller 58 is provided in spaced relation above the plane along which the thin slab would pass to arrive at nip rollers 60 which propel the slab rightwardly toward the final hot rolling train. The hold-back roller 58 rotates positively in the clockwise direction and its purpose is to facilitate the passage of the final portion of the thin slab which had previously been coiled up. By positively rotating the roller 58 in the clockwise direction, there will be a tendency to wipe the tail end of a coil upwards in order to prevent the formation of a folded-over portion which might otherwise become stuck, jammed or crumpled against the nip rollers 60.

Figure 6:
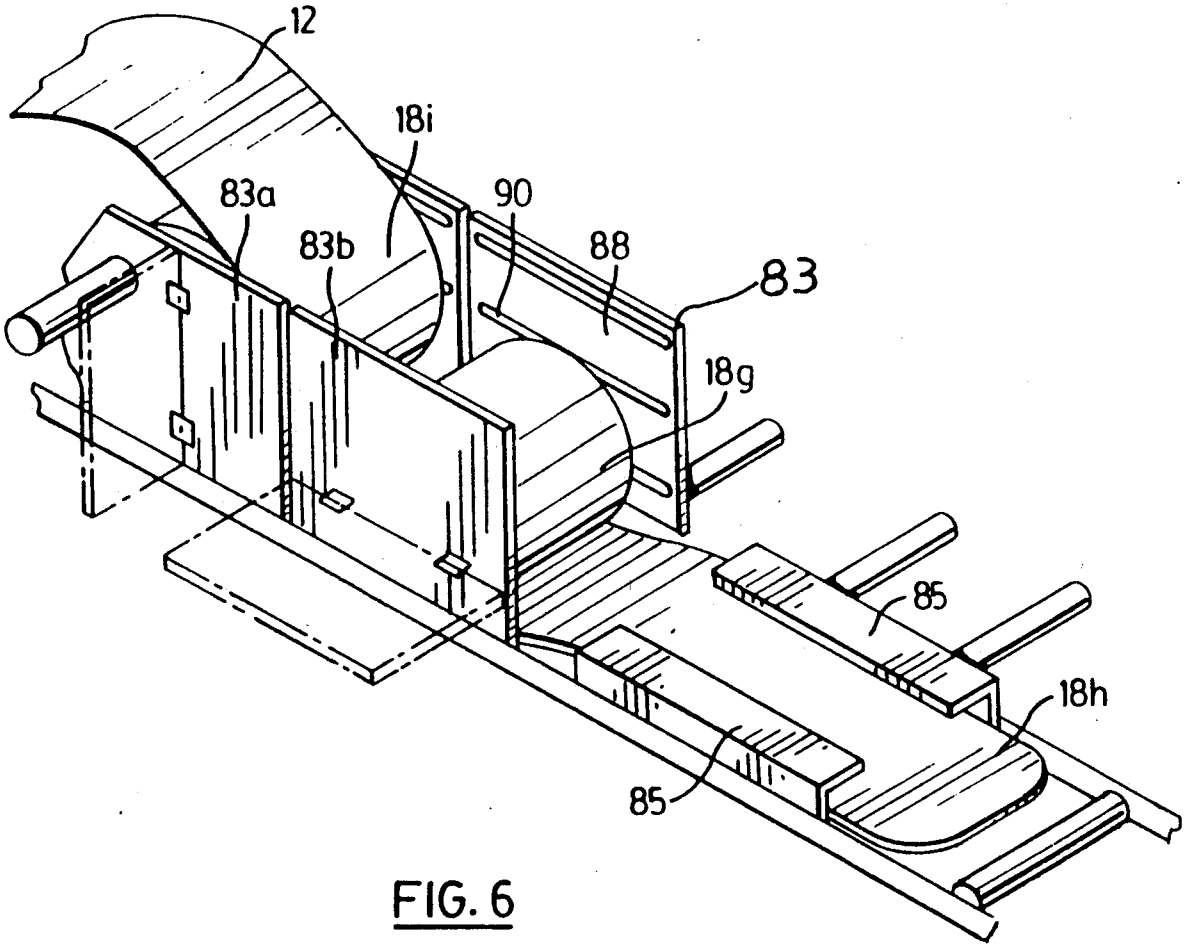
FIG. 6 is a perspective view of major portions of a mandrelless transfer coil box constructed in accordance with this invention.

Attention is now directed to FIG. 6, which illustrates an embodiment of the invention which does not necessitate a temperature equalization furnace, and in which the hot strip or slab 12 is coiled using the mandrelless downcoiler technique at a first position 18*i* (which may be referred as the coiling position), being supported by support rollers (not visible in FIG. 6) located under the coiling strip or slab 12. A coil 18*g* is shown at a second position downstream of the first position, the coil 18*g* being at the initial stage of uncoiling, with the leading end 18*h* just beginning to move rightwardly from the coil 18*g*.

In the arrangement shown in FIG. 6, heat shields 83 are provided, with inwardly projecting internal wear bars 90. As can be seen in FIG. 6, the individual heat shield panels 83*a* and 83*b* can be hinged about vertical or horizontal axes so that they can quickly and easily be moved out of the way in order to allow access to the assembly (for repair, etc.) At the right in FIG. 6, angle-shaped heat shields 85 are provided.

It will thus be appreciated that this development, in one of its particular embodiments, has provided a material buffer in the form of the furnace 20 which decouples the casting operation from the hot strip mill. In addition, the apparatus set forth above is able to process thin slabs from more than one casting machine. Particularly for carbon steel technology, this allows a fuller use of the available technology, in view of the fact that typical thin slab casting speeds (for 50 mm thick steel) are about 5 m/min, while entry speeds into high reduction tandem mills are significantly greater. This presents an over-production capacity of the hot rolling mill.

The design presented above is simple and minimizes capital investment and maintenance costs. Side heat shields are expected to provide good edge temperature control, and possibly to eliminate the necessity for induction heating. The heat shields may be of major benefit as a retrofit for the existing conventional mandrel-type coil boxes.

Figure 7:
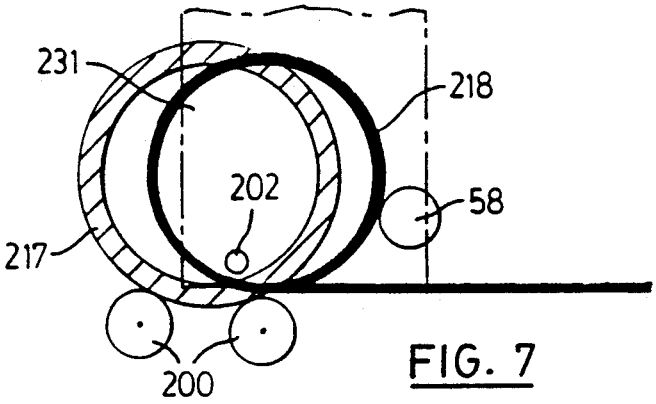
FIG. 7 is a schematic side elevational view of an uncoiling station of the kind illustrated in FIG. 5, showing an improvement to prevent jamming or crumpling of the tail end of an uncoiling strip or slab.
Figure 8:
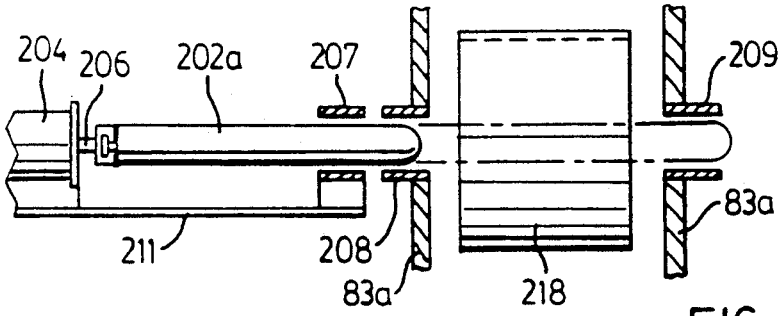
FIG. 8 is a schematic elevational view of one embodiment of the improvement shown in FIG. 7.
Figure 9:
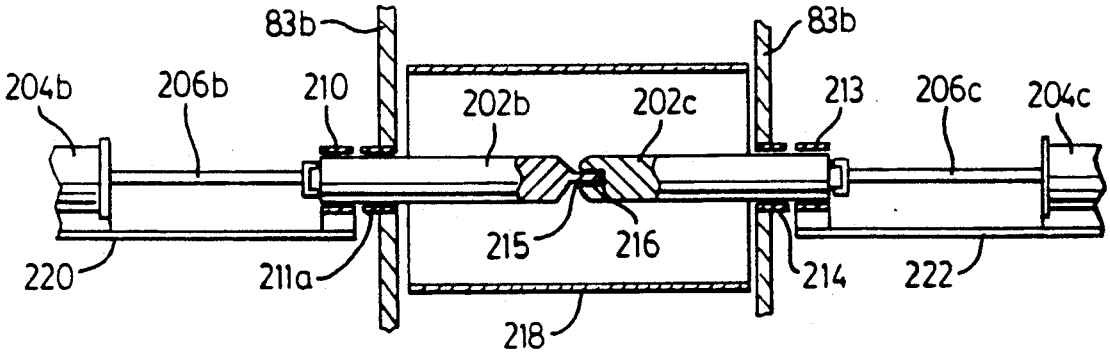
FIG. 9 is a schematic elevational view of second embodiment of the improvement shown in FIG. 7.

FIGS. 7, 8 and 9 disclose an improvement of the basic apparatus described above, useful to open up the wraps of a coil when paying off, for example into a hot strip mill.

When the coil in the "second" position (i.e. 18*g* in FIG. 2) has been unwound down to approximately the last four wraps, the coil will tend to be pulled downstream onto one of the pay-off rolls and against the holdback roll illustrated at 58 in FIG. 5. For relatively thick material, this may not be a problem. However, if the coiled material is very thin, the last one of two wraps will tend to collapse, crumple or fold against the holdback roll 58, and either not pay off evenly, or become jammed.

FIG. 7 shows the holdback roll 58 and two pay-off rolls 200 defining the "second" position where the coil initially rests when it is placed there. The coil 217 shown at the left in FIG. 7 represents the coil condition prior to being pulled away from the "second" position defined by the rollers 200. In this condition the coil 217 has more remaining wraps, and thus is illustrated as if it had a thicker "wall" in FIG. 7 (this thickness has been hatched rather than shown in solid ink). It will be seen that both of the coil conditions illustrated at 217 and 218 have the same approximate inner diameter, but that the leftward coil 217 has a larger outer diameter.

Particularly well seen in FIG. 7 is the fact that the inner "eye" of the coil 217 in the leftward position (in contact with the rollers 200) overlaps the eye of the coil 218 that has been pulled rightwardly (downstream) against the holdback roll 58. The overlapping region is identified by the numeral 231.

In order to prevent crumpling or jamming of the tail end of a slab or strip against the holdback roll 58, there is provided a coil opener pin 202 which can be inserted into the hollow center core of the coil from a lateral position, when the coil is down to the last few wraps. By arranging the position of the pin 202 such that it can enter the overlapping region 231 described above with respect to FIG. 7, it will not matter whether the coil opener pin 202 is inserted while the coil remains in the "second" position defined by contact with the supporting rollers 200, or whether this occurs after the coil has become light enough for the final few wraps to be pulled rightwardly, (downstream) against the holdback roll 58. It can be seen that the pin 202, positioned upstream of the holdback roll 58 (i.e. leftwardly from the holdback roll 58 seen in FIG. 7) is located such that it would be close to the inside surface of the innermost wrap of the coil 218 when the final convolutions have been pulled rightwardly against the holdback roll 58. It will be obvious from the above description and the illustration in FIG. 7 that the coil opener pin 202 will act to eliminate the risk of crumpling, jamming or folding of the tail end of a slab or strip.

FIGS. 8 and 9 illustrate two possible constructions for the mechanism which controls the position of the coil opener pin 202 (FIG. 7). In FIG. 8, a pneumatic or hydraulic cylinder 204 has a piston 206 which controls a coil-opener pin 202*a*, the latter being guided by sleeves 207, 208 and 209. The sleeves 208 and 209 may be supported by heat shield panels 83*a*, while the sleeve 207 is supported from a bracket 211 which also supports the cylinder 204. The structure shown in FIG. 8 is suitable for coils having a relatively small width. Preferably the pin 202*a* is rotatable about its axis, so that there is less friction as the pin contacts the inside of the coiled material.

FIG. 9 shows a double acting arrangement for wider coils. In FIG. 9, the coil 218 is enclosed within heat shield panels 83*b*. In FIG. 9 there are two coil opener pins 202*b* and 202*c*, which are controlled by separate cylinders 204*b* and 204*c*, having pistons 206*b* and 206*c*. Again, each coil opener pin 202*b* and 202*c* is guided. Pin 202*b* moves slidably through sleeves 210 and 211*a*, while pin 206*c* moves slidably through sleeves 213 and 214. As can be seen, the pins 202*b* and 202*c* are shaped to interconnect at the middle of the coil 218. More specifically, the pin 202*b* has a coaxial, integral pin 215 which is adapted to be received within a central bore 216 in the pin 202*c*.

Frames 220 and 222 are provided to support the cylinders 204*b* and 204*c*, respectively, and also to support the sleeves 210 and 214 respectively. The complete frame and cylinder may be attached to and travel in and out with the heat shield panels 83 to suit various coil widths.

Figure 10:
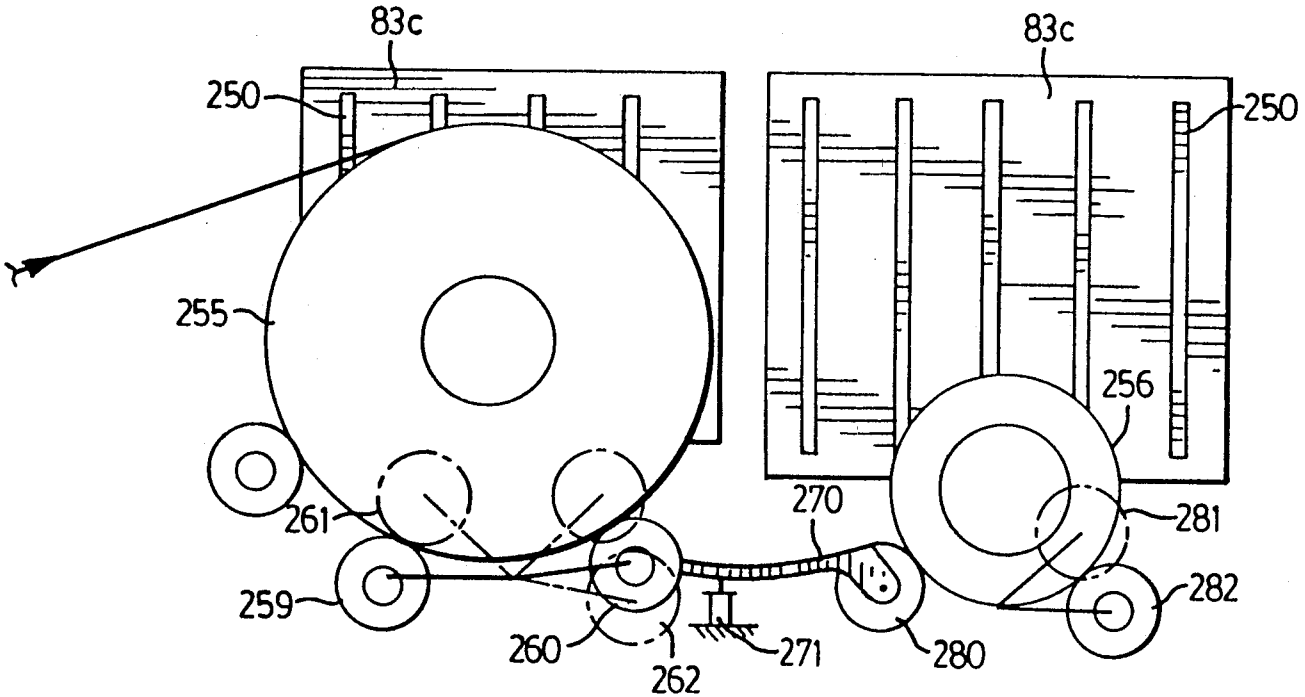
FIG. 10 is a schematic side elevational view of one embodiment of the portion of the apparatus immediately downstream of the temperature equalization furnace, similar to that shown in FIG. 6, including a variant of the same illustrated in broken lines.
Figure 12:
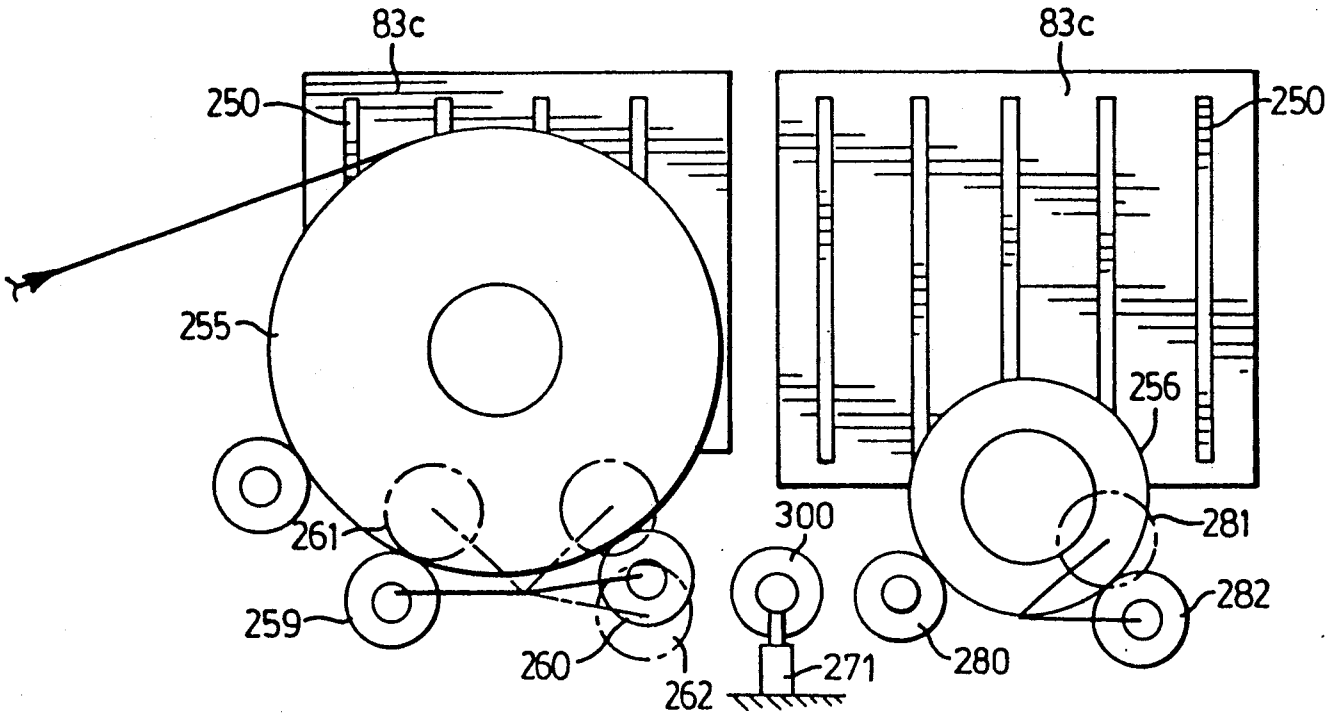
FIG. 12 is a view like FIG. 10, showing a modified form of the invention.

Attention is now directed to FIG. 10, which is a schematic side elevation of coiling rolls, a transfer ramp, uncoiling rolls and heat shields with radiant heaters. The particular arrangement of reciprocating rolls and transfer ramp in FIG. 10 illustrates an alternative method of coil support during coiling, coil transfer and uncoiling.

An almost complete coil 255 is shown resting on two coiling cradle rolls 259 and 260, constituting a "first" position for the coil 255. When the coil is complete (and there is no coil on the uncoiling rolls), roll 260 is lowered to position 262, and roll 259 is raised to position 261. The complete coil will be ejected onto the ramp 270 which is pivoted concentrically with roll 280. To this point, uncoiling has not yet begun.

The hydraulic cylinder 271 will then raise the ramp 270 and roll the coil onto the uncoiling cradle rolls 280 and 281, defining the "second" position. The receiving roll 281 may then be lowered to position 282, whereupon the uncoiling of the coil is initiated. A coil 256 is shown which is almost completely uncoiled.

The major advantages of this coil transfer embodiment are that there are fewer rolls and that the hydraulic system controls for the rolls are very simple.

FIG. 10 also shows the incorporation of electric (or otherwise) powered radiant heaters 250 and the heat shields 83*c*. The major advantage here is the ability to increase the temperature of the edges and the center eye of the coil, which are the most subject to heat loss during coiling and uncoiling.

It will be understood that the arrangement shown in FIG. 10 is an alternate of an arrangement which does not utilize a transfer ramp (270), but instead provides a further roller, as shown in broken lines at 300 in FIG. 10. The roller 300 would be movable vertically under the control of a hydraulic cylinder or the like, so that it could function similarly to the ramp 270.

Figure 11:
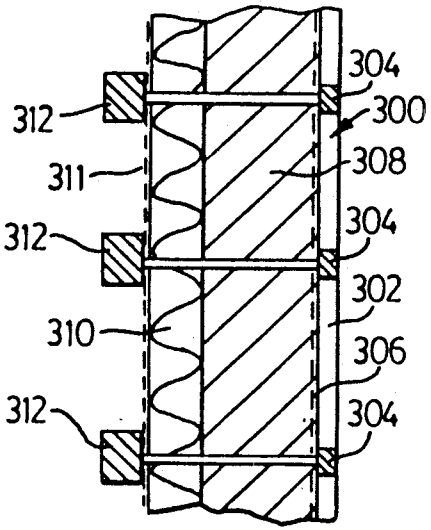
FIG. 11 is a vertical sectional view through a heat shield usable with this invention.

Attention is now directed to FIG. 11, which shows a cross-section through a heat shield capable of use with this invention. The heat shield shown in FIG. 11 includes a rear framework 300 consisting of vertical members 302 (seen in elevation rather than in section in FIG. 11), and horizontal members 304. The members 302 and 304 are preferably of steel. Secured against the leftward face of the framework 300 is a sheet of expanded mesh 306, typically 20 mm—9 expanded mesh. To the left of the expanded mesh 306 is a relatively thick layer of ceramic fiber board 308, with a typical thickness of 50 mm.

Leftwardly of the layer 308 is a ceramic fiber blanket 310, typically about 30 mm in thickness. Leftwardly of the blanket 310 is a further sheet 311 of expanded metal mesh, typically 20 mm—10, made of 309 stainless steel, and held in place with 100 mm 310 S.S. locating studs. Finally, the construction shown in FIG. 11 includes wear ribs 312, which may typically be 25×50 mm, 309 S.S.

SUMMARY

As continuous cast thin slabs exit from one or more casting machines, they enter one or more coiling devices in which the slabs pass through bend rollers which allow them to begin forming coils. The head end of a slab typically impacts on a forming roll which then forms the eye of the coil. As the thin slab is fed into the coiling device, the coil rotates and accumulates the thin slab.

When the thin slab is taken up to a predetermined coil mass, the slab is sheared by a shearing mechanism (not illustrated in the drawings) located between each casting machine and its respective coiling device. After the thin slab is sheared, the coiling speed of the coiling device can be increased so that an interval will be secured between the tail end of the leading slab and the head end of the following slab.

In one form of this development, the coiled thin slab is moved towards a temperature equalization furnace by a "rocking frame" or "walking coil" method in which the rear roll supporting the coil is lifted while the front roll supporting the coil is lowered. In the next support position, the previous front roll becomes the rear supporting roll, and a new roll becomes the front roll. This method can also be used to transfer the coil between the coiling device and the uncoiling device on the downstream side of the furnace.

When a coil reaches the entrance of the furnace, a door opens and the coil moves inside the furnace. The furnace may be heated and insulated, or simply insulated, and the internal furnace atmosphere can be adjusted to control scale formation. If desired, the coil can move forward (downstream) along the furnace by the "walking" method previously described, or alternatively by conventional walking beams. As the coil progresses through the furnace, temperature gradients between the center and the edge of the coil are reduced.

The residence time of the coil in the furnace depends on the forward speed of the coil and the length of the furnace itself. The minimum coil residence time is that required to ensure uniformity of temperature distribution throughout the coil. The maximum coil residence time is set by the production rate of the casting apparatus, the coil mass, and the length of the furnace.

When the hot reduction mill (not illustrated in the drawings) is available for rolling, the first coil emerging from the furnace is transferred to the uncoiling station. The uncoiling station can be integrated into the end of the furnace, or can be located immediately after the furnace. The coil is rotated to locate the tail end of the coil, and with the aid of a peeler arm the coil is unwound into the hot reduction mill.

As previously described in this disclosure, there are several different combinations of downcoiling, upcoiling, walking rolls (swing frames), etc. by which coils can be formed and then brought to the upstream end of the furnace.

In another form of this development, the furnace is dispensed with, and the coil is formed at a "first" position adjacently upstream from a "second" position where the coil will be uncoiled. When the coiling has been completed in the first position, a conventional peeler arm or the like initiates the separation of what will now be the leading end of the slab or strip (which was previously the tail end), the latter being fed downstream toward a hot rolling mill or other suitable process. While the uncoiling proceeds, the coil is moved from the first position to a "second" position adjacently downstream from the first, without contacting the open coil eye and without inserting anything into the eye. This can be done by raising and lowering various combinations of rollers or ramps below the coil, and on which the coil weight rests. Heat shield means is provided closely adjacent the side edges of the coil throughout its movement from the first to the second position, and for the whole time that the coil is in those positions, in order to restrict heat loss from the side edges and the coil eye. The provision of such closely adjacent heat shield means is not possible in arrangements where stub mandrels or the like mounted on transfer arms are inserted into the open eye of the coil in the first position, and then rotated to swing the coil to the second position. The presence of transfer arms or the like simply interferes with the positioning of the heat shield, which means that too much heat is lost.

According to a preferred aspect, when the coil nears the ends of the uncoiling procedure at the second position, a coil opener pin is inserted axially into the coil eye without contacting the coil, so that during the completion of the uncoiling operation, as the last few coil wraps are pulled downstream out of the second position, the inner wrap will contact the coil opener pin in such a way that the pin prevents collapsing or crushing of the final portion of the coil.

According to another preferred aspect, the coil-opener pin is provided as described above, but there is further added a holdback roll located downstream of the coil opener pin. Preferably, the holdback roll is located such that it is out of contact with the coil so long as the coil remains in the second position (i.e. in contact with the rollers 200 in FIG. 7), but is contacted by the coil when the latter is pulled downstream out of the second position near the end of the uncoiling operation. Contact with the holdback roll will then arrest downstream movement of the remainder of the coil, and it is preferred that this happen at a location at which the coil eye (in its pulled-out position) overlaps the position of the coil eye when the coil is in the "second" position (in contact with the rollers 200 in FIG. 7). The common area can be called the overlapping region, and during the procedure the coil opener pin is inserted into the overlapping region of the coil eye without contacting the coil, thereby to minimize heat loss through contact, while still ensuring that the tail portion of the strip or slab is not crushed, crumpled or jammed.

By providing the coil opener pin, it is possible to use a freely idling holdback roll 58, whereas if the pin were eliminated, the holdback roll 58 would have to be driven. Of course, so long as the coil opener pin is in position, it does not matter whether the holdback roll 58 is driven or simply idles.

It will be understood that the use of the overlapping region 231 (FIG. 7) for the positioning of the coil opener pin 202 means that the precise timing of the insertion of the pin 202 is not as critical as it would be in the absence of the holdback roll 58. In other words, the pin can be inserted either before or after the coil is pulled out of the "second" position and up against the holdback roll 58.

MAJOR FEATURES OF THIS INVENTION

1. Heat Retention Shield

It is contemplated to utilize heat retention shields during coiling, coil transfer, peeling and uncoiling. The heat shields may be of a re-radiating design along with the provision of wear ribs, like the ribs 312 shown in FIG. 11, to guard the insulating material from damage reflecting panels of aluminum with projecting steel wear ribs. The use of aluminum is practical for reflective heat retention, along with the provision of ribs to guard the aluminum from damage. A major advantage here is that it minimizes temperature loss from the coiled material, to ensure a uniform hot reduction mill entry temperature. Alternatively, refractory insulated heat shields could also be utilized.

2. Downstream Coil Transfer

The transfer of coils in the downstream direction is accomplished by roll transfer (roll pairs or a single roll), using movable and vertically reciprocating rolls to shift the various coils in a desired direction. In an alternative embodiment, one or more roll can be replaced by a swing-mounted ramp, or can be linked together in pivoted frames. Two immediate advantages of the roller/-ramp transfer system are (a) the elimination of the inner eye heat loss to a mandrel, and (b) the elimination of obstructions to the heat retaining panels.

3. Furnace

The primary function of the coil furnace, used in one embodiment of this invention, is to equalize the temperature distribution across the width of the coil. The furnace is also utilized to accumulate coils in the event of upstream or downstream processing problems. Coil transfer within the furnace can utilize the conventional walking beam method in order to avoid rolling the outer wrap of the coil.

4. Peeling

The peeler arm shown at 22 in FIG. 5 is similar to current and conventional technology, but in this case it is separated from the coiling device.

5. Uncoiling

In accordance with one aspect of the present invention, the uncoiling device uses an exit roll holdback system involving an idling or counter-rotating roll 58 (FIG. 5) prior to the pinch rolls (60) to guide and straighten the last (inner) wrap, in combination with a coil opener pin. This allows the uncoiling to proceed without a mandrel, thus minimizing heat loss from the inner wrap. The elimination of a mandrel will also allow effective side heat shielding.

While several embodiments of this invention have been illustrated in the accompanying drawings and described hereinabove, it will be evident to those skilled in the art that changes and modifications may be made therein, without departing from the essence of this invention, as set forth in the appended claims.

The embodiments of the invention in which an exclusive property or privilege is claimed are defined as follows:

1. A method of manipulating a coil of hot metallic material having an open coil eye, utilizing an apparatus having a first coil support defining a first coil position, a second coil support defining a second coil position, and means for transferring a coil from said first position to said second position while the coil axis remains transverse to the direction of coil movement, the method comprising the steps of a) placing a coil in said first position then, b) initiating an uncoiling operation, c) transferring said coil to said second position with the coil transfer means, without contacting the open coil eye and without inserting anything into the eye, while restricting heat loss from the side edges and the coil eye by shielding the side edges of the coil throughout its movement from its first position to its second position, and d) inserting an axially movable coil opener pin, disposed adjacent to said second position and parallel to the coil axis, into the coil eye, without contacting the coil, when the coil is near the end of the uncoiling operation at said second position and then allowing the last few coil wraps to contact the pin as the coil is pulled out of the second position, such that the pin prevents collapsing or crushing of the final portion of the coil.

2. The method of claim 1, wherein a holdback roll is disposed adjacently downstream of said second position, the holdback roll being located such that (1) it is out of contact with the coil so long as the coil remains in said second position, and (2) it is contacted by said coil when the latter is pulled downstream out of its second position near the end of the uncoiling operation, and the inserting step comprises positioning the holdback roll such that its contact with the coil arrests the downstream movement of the remainder of the coil at a location in which the coil eye overlaps the position of the coil eye when the coil is in said second position, the common area being called the overlapping region and thus not contacting the coil until the coil is drawn out of the second position and up against the holdback roll.

3. The method of claim 1, wherein the pin is allowed to rotate freely during the inserting step.

4. The method of claim 1, further including a step of positively rotating the holdback roll in the opposite sense from the rotation of the coil when uncoiling.

5. The method of claim 1, wherein the transferring step includes raising and lowering in a predetermined sequence selected ones of a plurality of support rollers located below the coil and between the first and second positions, a coiling operating being initiated while the coil is in the first position, and the uncoiling operation being initiated after the coil reaches the second position.

6. The method of claim 1, wherein the transferring step is accomplished by raising and lower, in a predetermined sequence, selected ones of a plurality of support rollers and at least one pivoted ramp located below the coil and between the first and second positions, the uncoiling operation being initiated after the coil reaches the second position.

7. The method of claim 1, in which the placing step includes utilizing a mandrel-less downcoiling process to coil up an elongate piece of said hot metallic material at said first coil position.

8. The method of claim 1, further comprising a step of re-radiating heat from the coil side edges back to the coil during the transferring step by means of a heat shield.

9. The method of claim 8, wherein the placing step includes coiling an elongate piece of said hot metallic material at a location remote from said first position to produce a coil, then passing the coil through a temperature equalization furnace immediately upstream of said first position.

10. An apparatus for manipulating a coil of hot metallic material having an open coil eye, comprising:

a first coil support defining a first coil position a second coil support defining a second coil position means for transferring a coil from said first position to said second position while the coil axis remains transverse to the direction of coil movement, heat shield means located closely adjacent the coil throughout its movement from the first position to the second position, for restricting heat loss from side edges of the coil and the coil eye while the coil moves, and a coil opener pin adjacent to said second position and parallel to the coil axis, the pin being capable of axial movement whereby it can be inserted into the coil eye, without contacting the coil, when the coil is near the end of the uncoiling operation at said second position, such that the last few coil wraps contact the pin as the coil is pulled out of the second position, and the pin prevents collapsing or crushing of the final portion of the coil.

11. The apparatus claimed in claim 10, further comprising a holdback roll adjacently downstream of said second position, the holdback roll being located such that (a) it is out of contact with the coil so long as the coil remains in said second position but (b) is contacted by said coil when the latter is pulled downstream out of its second position near the end of the uncoiling operation, and (c) its contact with the coil arrests the downstream movement of the remainder of the coil at a location in which the coil eye overlaps the position of the coil eye when the coil is in said second position in an overlapping region, said pin being positioned such that it can be inserted into said overlapping region, thus not contacting the coil until the coil is drawn out of the second position and up against the holdback roll.

12. The apparatus of claim 10, further comprising a mandrel-less downcoiling apparatus by which an elongate piece of said hot metallic material can be coiled up.

13. The apparatus of claim 10, wherein said heat shield means includes re-radiating panels with a light-reflective inner surface and inwardly protruding wear bars, said inner surface being adapted to re-radiate radiant heat from the coil side edges back to the coil.

* * * * *